United States Patent [19]

Heiland

[11] Patent Number: 4,550,905

[45] Date of Patent: Nov. 5, 1985

[54] HIDE TRANSFER APPARATUS

[75] Inventor: Wolfgang K. Heiland, Trevose, Pa.

[73] Assignee: The United States of America as represented by the Secretary of Agriculture, Washington, D.C.

[21] Appl. No.: 625,272

[22] Filed: Jun. 27, 1984

[51] Int. Cl.[4] ..... B65H 31/00

[52] U.S. Cl. ..... 271/202; 271/69; 271/85; 271/204; 198/470.1

[58] Field of Search ..... 198/572, 574, 651, 652, 198/678, 680, 685–687, 695, 802, 473, 477, 479; 271/69, 85, 175, 184–185, 204–206, 277, 202, 203

[56] References Cited

U.S. PATENT DOCUMENTS 4,399,991 8/1983 Everall, Jr. et al. ..... 198/473 X
4,478,328 10/1984 Heiland ..... 198/479

FOREIGN PATENT DOCUMENTS 2101506 7/1971 Fed. Rep. of Germany ..... 271/175
0290259 10/1953 Switzerland ..... 271/175
0937417 9/1963 United Kingdom ..... 271/175

OTHER PUBLICATIONS

JALCA 78, No. 9, 267–276, 1983.
JALCA 74, 140, 1979.

*Primary Examiner*—Joseph E. Valenza
*Assistant Examiner*—Lyle Kim
*Attorney, Agent, or Firm*—M. Howard Silverstein; William E. Scott; David G. McConnell

[57] ABSTRACT

An apparatus and method for transferring semiautomatically cattlehides from one hide transport conveyor to a second faster moving transport conveyor.

6 Claims, 8 Drawing Figures

HIDE TRANSFER APPARATUS

BACKGROUND OF THE INVENTION

1. Field of the Invention

This invention relates to an apparatus for transferring semiautomatically cattlehides from one hide transport conveyor to another. More specifically, it relates to an apparatus for transferring semiautomatically hides from a first transport conveyor on which the hides are carried through a series of chemical treatment baths while folded over bars which are tightly spaced and slow moving to a second conveyor on which the hides are carried through a series of mechanical operations at a rapid pace while clamped on one end and spaced a great distance apart.

2. Description of the Art

Although carrier bars and clamps, such as toggle clamps, are used in the processing of cattlehides and other materials, hides are manually assembled on the bars or clamps. There is no known apparatus that eliminates any manual operation in the transfer of a hide from a bar to a clamp. The most relevant known art is that described in Das Leder 28, 81–89, 1977 and in an abstract of the Das Leder article in JALCA 74, 140, 1979. However, in the apparatus and method described therein the hides are manually loaded onto and removed from bars. Subsequent mechanical processing does not utilize clamps. It is done by manually feeding these hides into conventional fleshing and splitting machines.

SUMMARY OF THE INVENTION

An object of this invention is to provide an apparatus and method for removing cattlehides from carrier bars over which they are draped and transfer them so that they are clamped at or near one end of the hide only.

Another object is to provide an apparatus to semiautomatically transfer cattlehides from a hide transport conveyor in which the hides are draped over carrier bars to a second transport conveyor on which the hides are clamped at one end only. A further object is to provide an apparatus to semiautomatically transfer the cattlehides for subsequent automatic mechanical operations.

A still further object is to provide an appratus for semiautomatically and remotely transferring cattlehides from slow moving bars to fast moving clamps.

Another further object of this invention to provide a semiautomatic and remote means of transferring cattlehides that protects the operators from contact with toxic and dangerous chemicals and that protects the operators from being injured by the conveyor systems.

Another further object of this invention to provide a semiautomatic and remote means of transferring cattlehides that protects the operators from contact with toxic and dangerous chemicals and that protects the operators from being injured by the conveyor systems.

Another still further object is to make the transfer of hides from the first conveyor system to the second conveyor system at the rate of two hides per minute.

According to this invention, the above objects are accomplished by an apparatus comprising a slowmoving hide transport conveyor equipped with tightly spaced carrier bars, a semiautomatic transfer station equipped with a hide spreader, a draw-down frame with two mechanical hands, a console and a fast moving hide transport conveyor having automatically operated, widely spaced hide clamps.

While the figures and the description are directed to the processing and transfer of sided cattlehides, it is easily seen that to process whole hides the only adjustment necessary is to increase the width of the apparatus to accomodate the whole hides.

DESCRIPTION OF THE INVENTION

Figure 1:
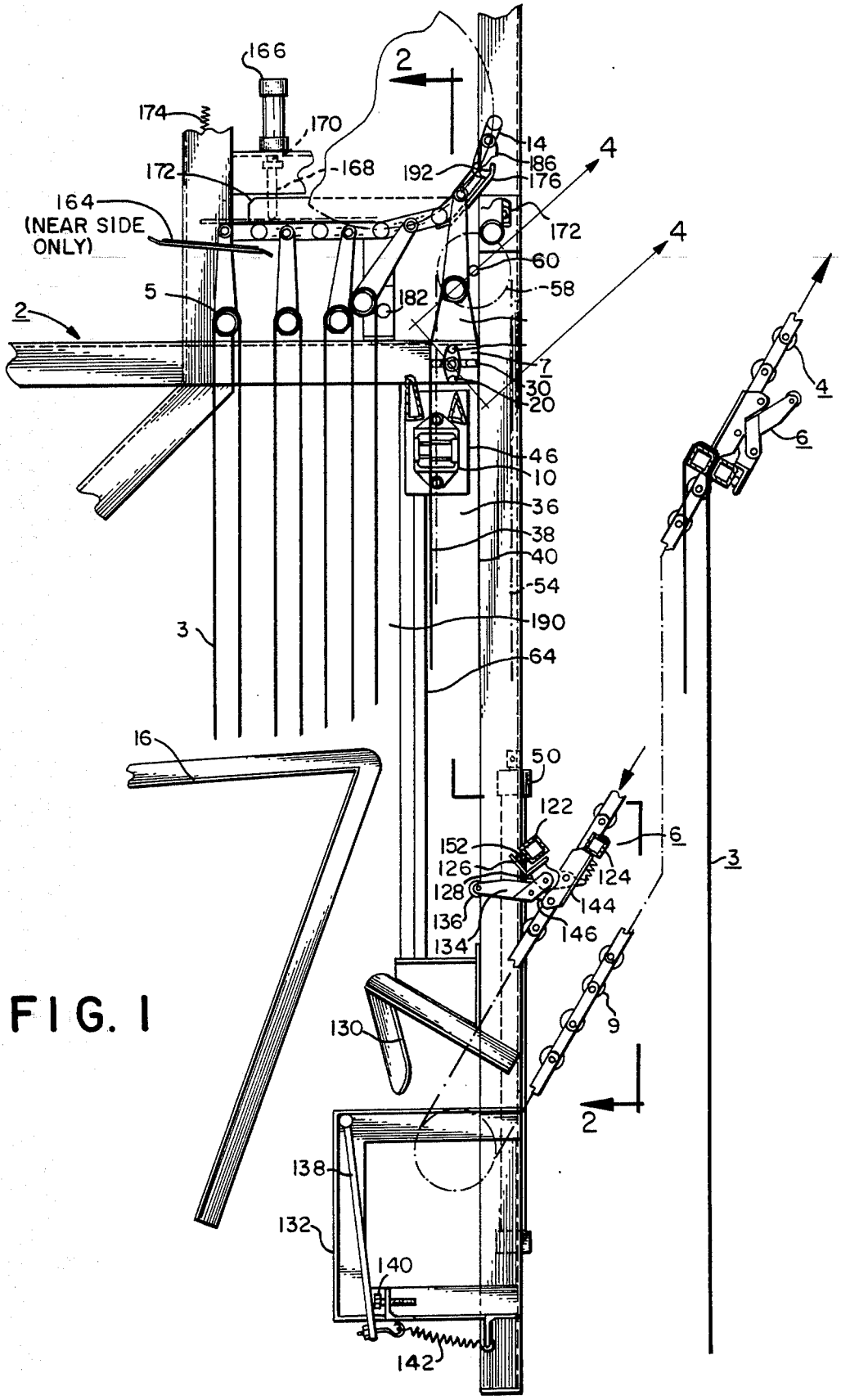
FIG. 1 is a side elevation of the apparatus with the near side frame member omitted. It shows the tightly spaced hides folded over their carrier bars with one hide in the transfer position, ready to be transferred.

This invention as described with reference to FIGS. 1 to 8, is used in conjunction with 2 hide transport conveyors 2 and 4. On the first conveyor 2 the hides 3 are folded over carrier bars 5 as described in U.S. Patent Application Ser. No. 333,945 filed Dec. 23, 1981, for a compact arrangement requiring minimum soaking and unhairing volumes as the hides are conveyed fully submerged and agitated through two soaking vats and one unhairing vat (not shown). The carrier bars 5 are arranged one on every link of chains 12 and 14 in order to achieve high density in a slow process as shown in FIG. 1. On the other hand, conveyor 4 operates at a speed compatible with conventional tanning equipment, for example, an unhairing machine, a fleshing machine, and a splitter (these machines are not shown). Mechanical processing in these machines requires that the hides, which are at this stage in the process held on one end in Clamps 6, be separated from each other by a much greater distance than when they are on carrier bars 5. Clamps 6 are transported on conveyor 4 by roller chains 15. Dripping-off onto drainboard 16 after having just emerged from an unhairing bath containing an aqueous solution of 2% to 6% sodium sulfide and 2% to 10% sodium chloride, the hides 3 are quite slippery at the time of transfer.

When a hide arrives in the transfer position 18, spreader 7 automatically moves under bar 5. When spreader 7 reaches the center of conveyor 2, rods 20 and 22 stop the forward movement of head 24 while rod extension 26 continues to move forward. This reduces the distance between head 24 and rod extension 26 causing two horizontal spreader rods 28 and 30 to pivot around pin 32 as controlled by links 34 thus increasing the space 36 between hide halves 38 and 40. By manually raising lever 42 on pneumatic control valve 44 of console 8, draw-down frame 46 moves up. This happens as compressed air from valve 44 enters the rod-end side of air cylinders 48 and 50 driving their pistons downward. By means of two roller chains 52 and 54, sprockets 56 and 58 (56 is on near side and not shown), and synchronizing shaft 60, both ends of the draw-down frame 46 move up without tilting from the horizontal which would cause binding. Side movement and back and forth rocking of the draw-down frame 46 are prevented by vertical square guide posts 62 and 64 bolted to frame 66 of conveyor 2 and V-grooved wheels 68, 70, 72 and 74 on draw-down frame 46. Draw-down frame 46 is a frame with a narrow or slit-like opening that is crosswise to conveyors 2 and 4, that is, the length of the opening is across the width of the conveyors. Frame 46 has two cross members that are wedge-shaped on top so that hide-half 38 will enter the opening between the two frame members as frame 46 moves up. The wedge shape of the cross members of frame 46 is instrumental in placing hide-half 38 in line to be gripped between the open jaws 88, 90, 92 and 94 of hands 9 and 10 which are attached to draw-down frame 46. When a predetermined portion of hide-half 38 shows below draw-down frame 46, upward travel of of this frame 46 is stopped by manually moving lever 42 of valve 44 to its center position. This way hides 3 that may vary greatly in length are always gripped the same distance from the end, resulting in subsequent even clamping in clamp 6.

Figure 2:
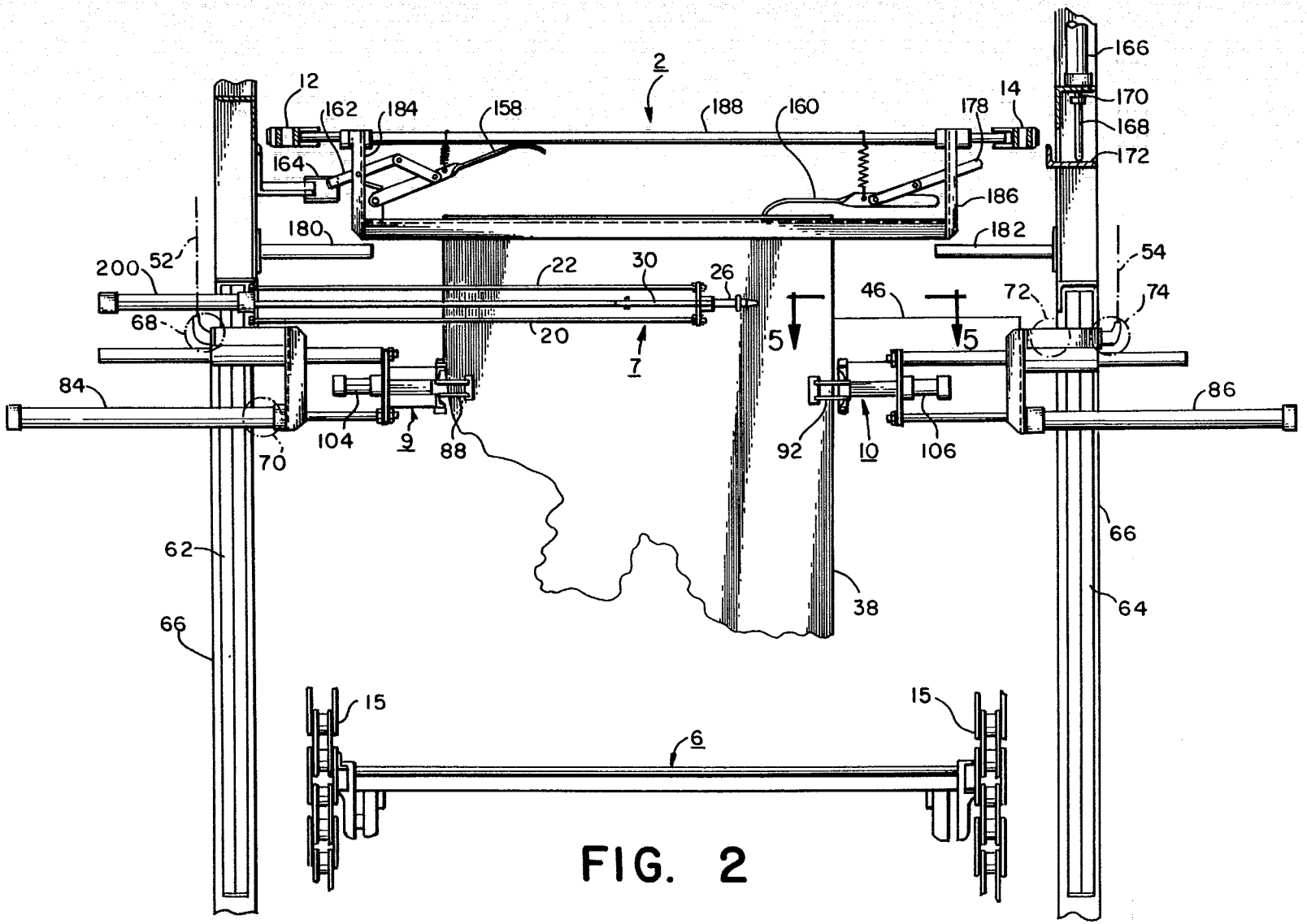
FIG. 2 is an end elevation, partially in section along line 2—2 of FIG. 1, showing a hide ready for transfer with the jaws of the mechanical hands ready to grip the hide.
Figure 3:
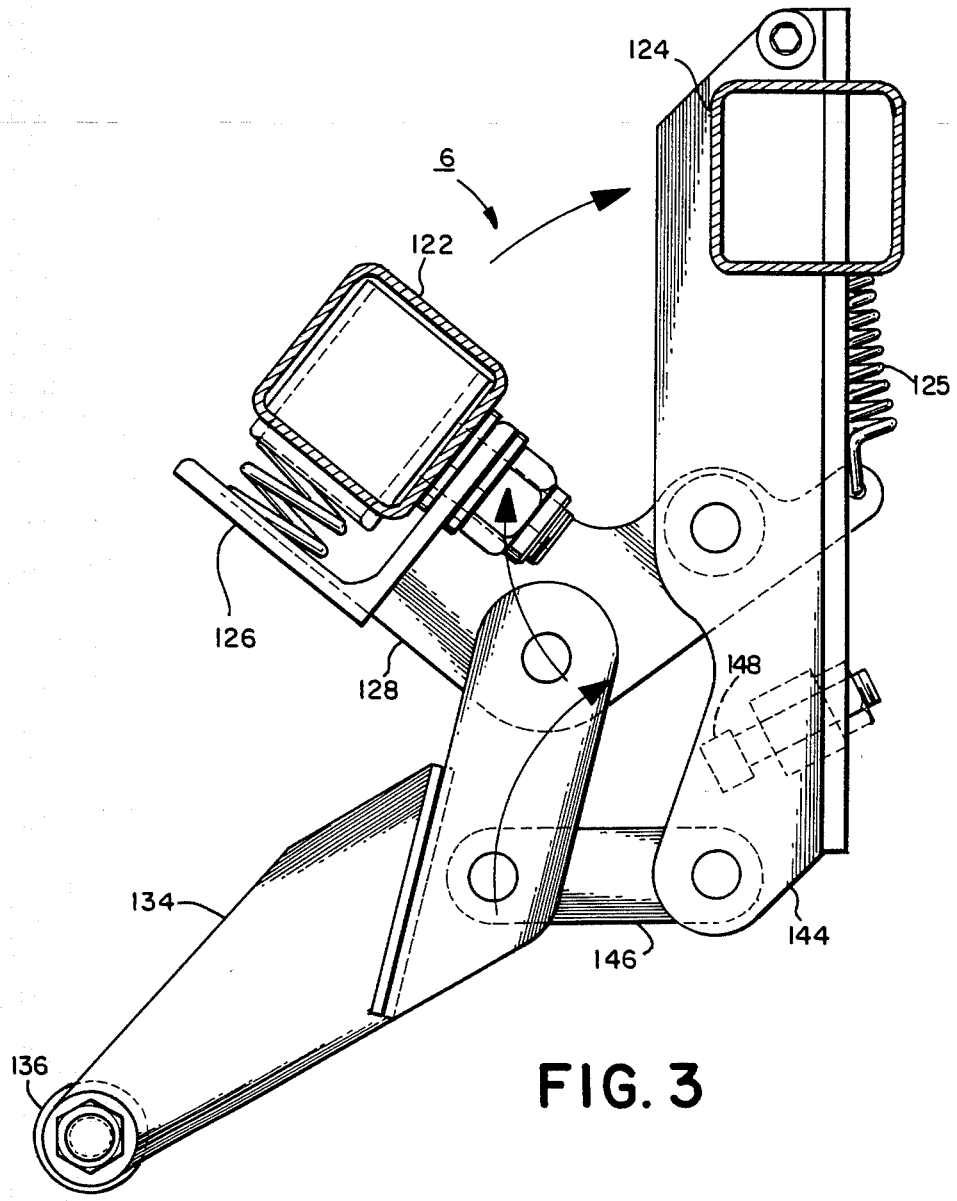
FIG. 3 is a cross section of the hide clamp.
Figure 4:
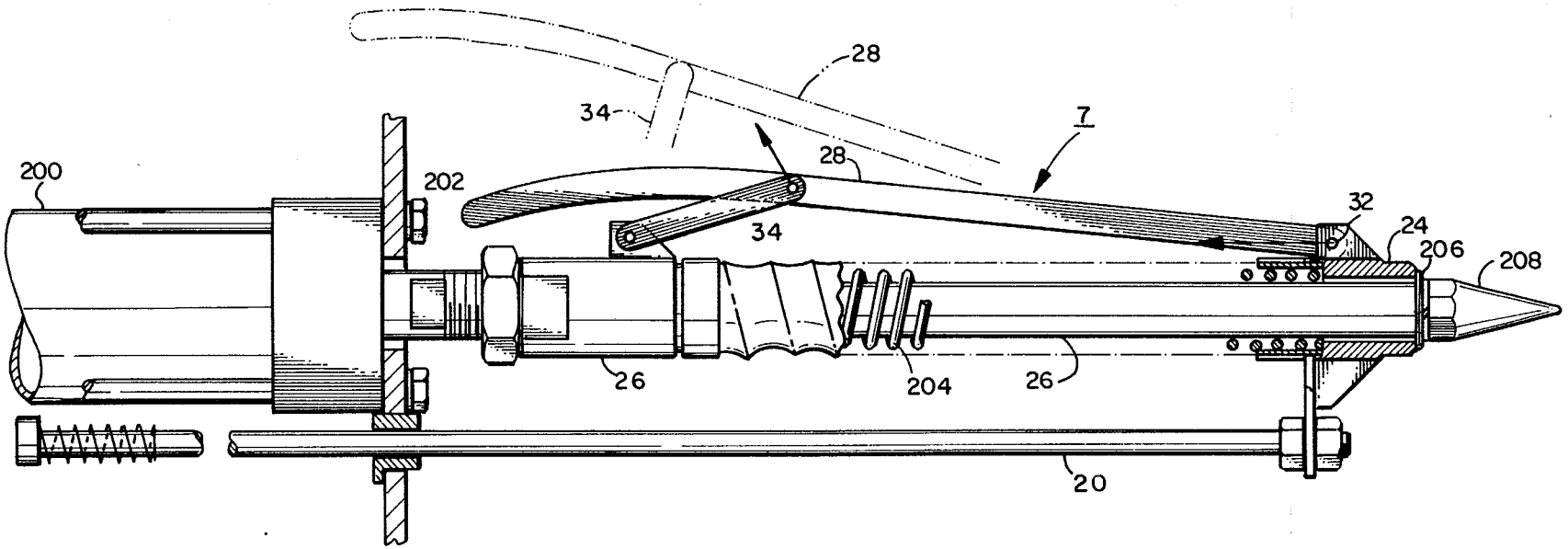
FIG. 4 is a section along line 4—4 of FIG. 1 showing the hide spreader in the retracted position.
Figure 5:
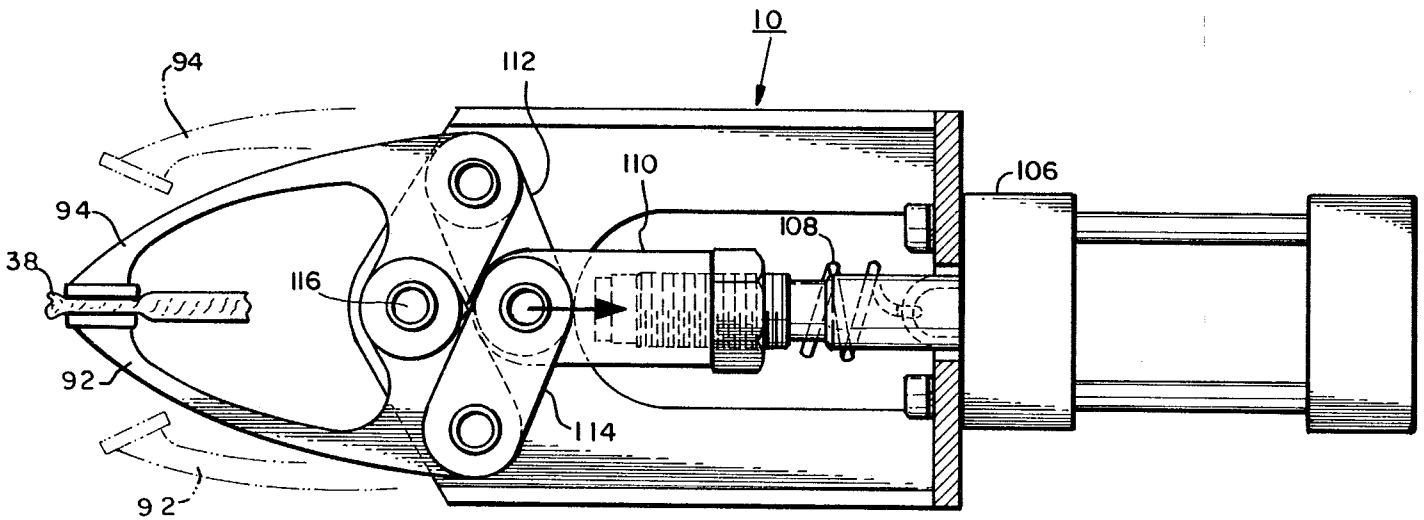
FIG. 5 is a top view along line 5—5 of FIG. 2 of one of the mechanical hands.
Figure 6:
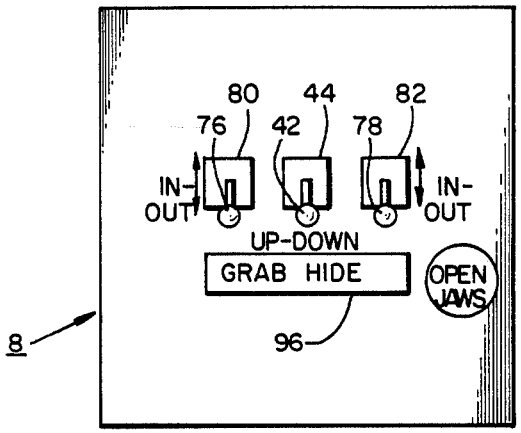
FIG. 6 is a view of the console.
Figure 7:
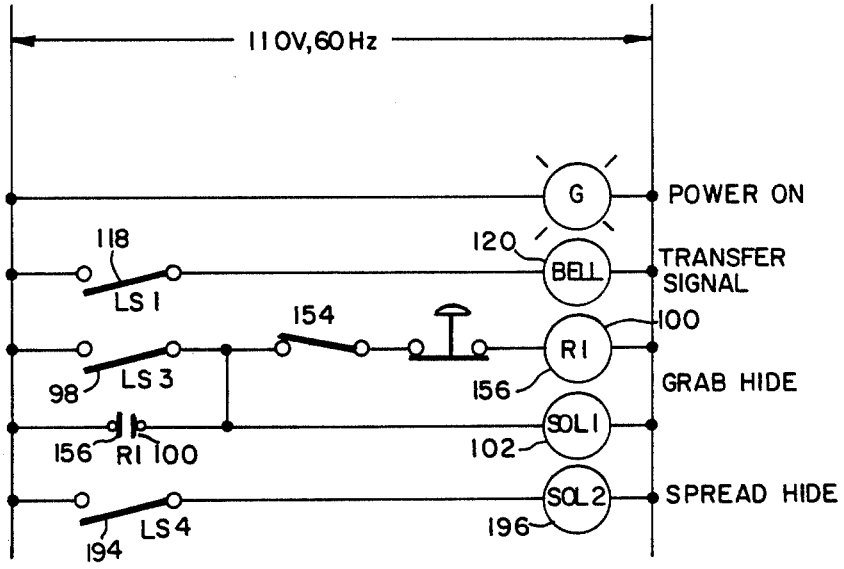
FIG. 7 is an electrical schematic.
Figure 8:
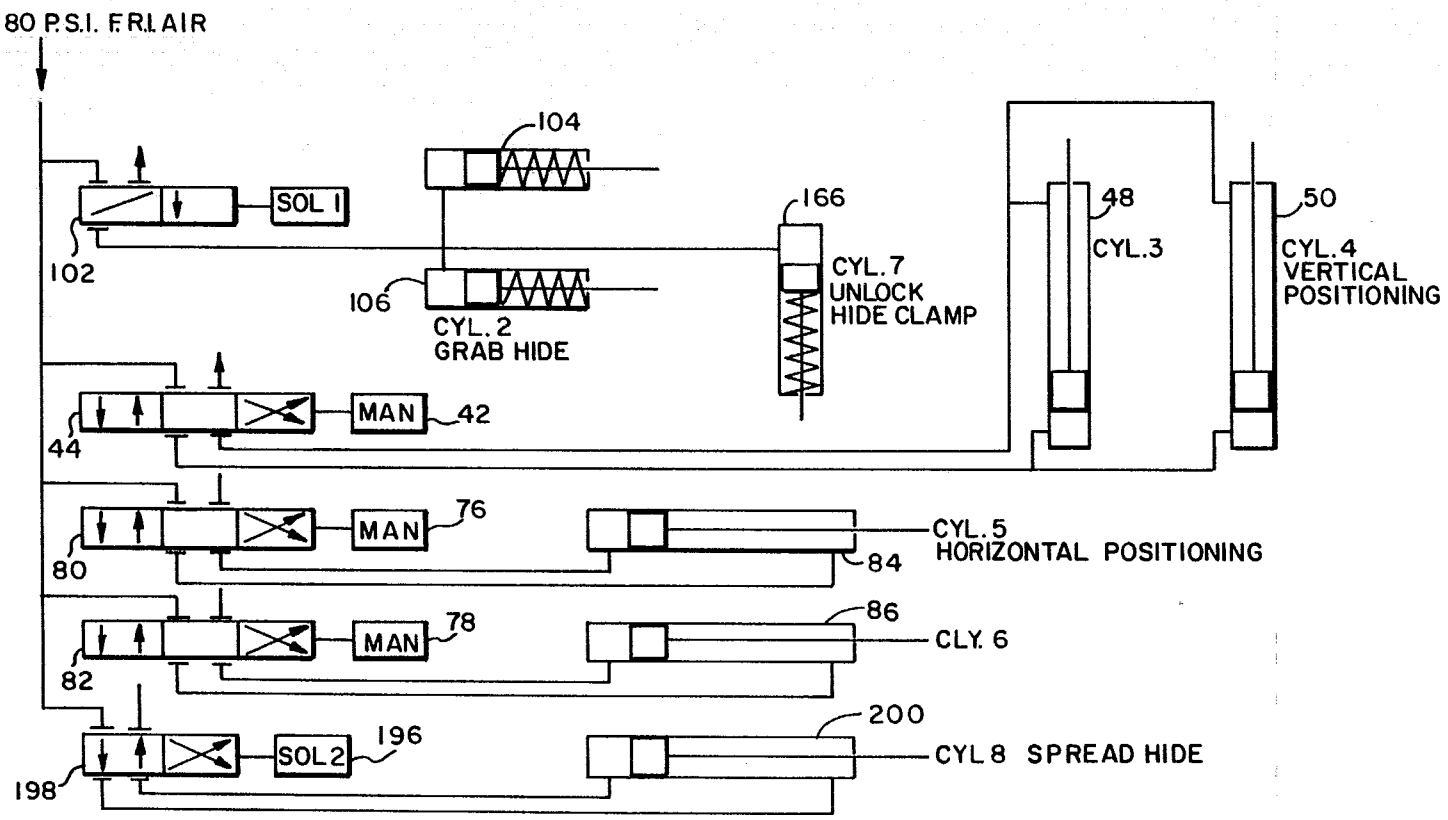
FIG. 8 is a pneumatic schematic.

After the upward movement of draw-down frame 46 is stopped, mechanical hands 9 and 10, are moved inward by manually raising levers 76 and 78 on valves 80 and 82, this pressurized the blind end of air cylinders 84 and 86, and the mechanical hands 9 and 10 move in until the open jaws 88, 90, 92 and 94 of hands 9 and 10 (90 and 94 are on the other side of hide-half 38 and are not shown in FIG. 2, 94 is shown in FIG. 5) are past the edge of hide-half 38. At this time levers 76 and 78 are returned to the center position of valves 80 and 82 and the mechanical hands 9 and 10 stop. By depressing bar 96 on console 8, electrical contacts on limit switch 98 are momentarily closed, energizing relay 100. By means of a normally open set of electrical contacts on relay 100, solenoid valve 102 is energized and compressed air is admitted to the blind side of air cylinders 104 and 106. Against the pull of extension spring pairs 108, piston rods of cylinders 104 and 106 extend. By means of clevis 110, link 112 and link pair 114 the jaws 88, 90 and 92, 94 close on hide-half 38 as they pivot about pin 116.

In order to synchronize the hide transfer with hide transport conveyor 4, hide clamp 6 contacts limit switch 118 which through its normally open contacts rings bell 120 as the clamp 6 approaches the transfer position. At this instant, lever 42 of valve 44 is moved down from the center position. This causes compressed air to be admitted to the blind end of air cylinders 48 and 50 driving their pistons upward. Aided by its own weight, the draw-down frame 46 quickly moves downward pulling hide 3 off bar 5 and the lower part of hide-half 38 enters between bars 122 and 124 of clamp 6 held in the open position by extension spring 125. As the draw-down frame 46 reaches its lowest point of travel, clamp 6 on conveyor 4 has advanced to a point when angle 126 of link 128 on clamp 6 makes contact with stop 130 of clamp closing means 132 and clamp 6 starts to close. This causes lever 134 to rotate downward and as clamp 6 continues in its travel, roller 136 makes contact with locking bar 138 of closing means 132. Held against stop 140 by extension spring 142, locking bar 138 applies a nearly constant force against roller 136 and toggle mechanism 144 is forced into its locked position as link 146 contacts stop 148.

Two compression springs 150 and 152 provide a strong, but controlled clamping force on bar 122 and hide 3 is firmly held in clamp 6 as required for the subsequent mechanical operations. On the other hand, because of the controlled clamping force through springs 150 and 152 and the smooth surfaces of the clamping bars 122 and 124, there is no clamping damage to the hides.

In the meantime, as clamp 6 started to close, it made contact with limit switch 154, opening the hold circuit 156 to relay 100 which becomes de-energized and solenoid valve 102 also becomes de-energized. This vents the blind end of air cylinders 104 and 106 and jaws 88, 90, 92 and 94 open automatically. Lowering levers 76 and 78 on valves 80 and 82 returns mechanical hands 9 and 10 to their extreme outward position. The transfer station is now ready for the next hide to enter transfer position 18 and the transfer will be repeated.

As previously stated, the hides 3 are very slippery when they arrive in the transfer position 18. Toggle clamps 158 and 160 have kept the hides 3 on carrier bars 5 during the previous processing steps of soaking and chemical unhairing. As the hides 3 approach transfer position 18, clamp 158 opens automatically as lever 162 contacts shoe 164. However, clamp 160 is kept closed until mechanical hands 9 and 10 grip hide half 38. Clamp 160 opens when together with air cylinders 104 and 106 air cylinder 166 is pressurized at its blind end and extension 168 of piston rod 170 contacts lever 172. This causes lever 172 to rotate counterclockwise against the pull of extension spring 174. Shoe 176 which is permanently attached to lever 172 pushes down on lever 178 of clamp 160. This causes clamp 160 to snap open and hide 3 can be pulled off its carrier bar 5. Together with the automatic opening of jaws 88, 90, 92, and 94 lever 172 returns to its original position as the blind end of cylinder 166 is vented.

Stumblers 180 and 182, in the meantime, hold back the next hide carrier bar 5. As sides 184 and 186 of hide carrier bars 5 contact stumblers 180 and 182 hide carrier bar 5 pivots around rod 188. Stumblers 180 and 182 are adjusted in such a way that a gap 190 between consecutive hides of sufficient width is formed and the person operating console 8 can see hide half 38 for proper positioning of mechanical hands 9 and 10.

Mechanical hands 9 and 10 are designed in a failsafe manner. Should an electrical or pneumatic stoppage occur, jaws 88, 90, 92 and 94 will open automatically, releasing their grip on hide half 38.

Lever 172 also is designed in a fail-safe manner. If, for any reason, clamp 160 is still in its locked position after having passed transfer station 18, an extension 192 of lever 172 opens clamp 160.

As hide carrier 5 leaves and before the next hide enters transfer position 18, limit switch 194 opens, deenergizing coil 196 of solenoid valve 198. This vents the blind end of air cylinder 200 and pressurizes its rod-end. As piston rod 202 retracts, rod extension 26 also retracts. Spreader rods 28 and 30 fold inward as extension spring 204 increases the distance between rod extension 26 and head 24. Inward movement of spreader rods 28 and 30 stops when heard 24 contacts washer 206 under bolt 208 on end of rod extension 26. With the spreader rods 28 and 30 folded, the hide spreader 7 continues to retract until air cylinder 200 has reached the limit of its stroke. The spreader 7 is ready for the next hide to move into transfer position 18.

In order to fully describe the semiautomatic operation of the invention, the foregoing description includes details of the hydraulic and electrical systems. However, these systems are standard and not considered part of the subject invention. Basically, the invention is the apparatus devised for transferring hides from one conveyor to a second conveyor which is moving at rapid pace relative to the speed of the first conveyor. On the first conveyor 2, each hide is draped over a carrier bar 5 so that as it is transported about half of the hide 40 can be referred to as the leading half while the other half 38 is the trailing half. When each hide reaches transfer position 18, spreader 7 moves under bar 5, horizontal spreader rods 28 and 30 pivot around pin 32 and increase the distance or space 36 between hide halves 38 and 40. Draw-down frame 46 moves vertically up the frame of conveyor 2 as previously described, the trailing half-hide 38 enters the slit-like opening in 46 until a predetermined portion of half-hide 38 shows below frame 46 and then the upward travel of 46 is stopped. At this point hands 9 and 10 are moved inward and jaws 88, 90,92 and 94 close on half-hide 38. Frame 46 then moves downward pulling hide 3 off bar 5. In the meantime, the lower part of half-hide 38 enters and is clamped between bars 122 and 124 of clamp 6. As clamp 6 continues to be transported on conveyor 4 it pulls hide 3 with it and thereby completes the transfer of the hide from conveyor 2 to conveyor 4.

I claim:

1. An apparatus for transferring hides from one conveyor on which each hide is draped over a carrier bar at about the center of its lengthwise dimension to a second, faster moving conveyor on which the hides are held at one end only, comprising, in combination, means for spreading apart the halves of a hide draped over a carrier bar, means for guiding and positioning a spread-apart hide-half for transfer of the hide to the second conveyor, means for gripping the leading edge of the foregoing guided and positioned hide-half to pull the hide off the carrier bar, and means for clamping the leading edge of the hide to transfer the hide to the second conveyor.

2. An apparatus for transferring hides from a first conveyor on hich the hides are transported through a series of operations while they are draped over carrier bars to a second conveyor on which the hides are transported through a series of operations while they are clamped on one end, comprising, (a) a spreader for spreading apart the two halves of a hide draped over carrier bars on the first conveyor;

(b) a draw-down frame for guiding and positioning a spread-apart hide-half from step (a) to be transferred to the second conveyor;

(c) a pair of mechanical hands having closable jaws to grip near its leading edge the hide-half guided and positioned by the draw-down frame; and (d) a clamp to grip the leading portion of the hide and complete the transfer of the hide to the second conveyor.

3. The apparatus of claim 2 wherein the spreader has a pair of spreader rods for spreading apart the two halves of the hide draped over the carrier bar.

4. The apparatus of claim 2 wherein the draw-down frame has two cross members with a narrow opening between the members.

5. The apparatus of claim 4 wherein the cross members are wedge-shaped.

6. The apparatus of claim 2 wherein the clamp is an integral part of the second conveyor.

* * * * *